US009675152B2

(12) United States Patent
Lim et al.

(10) Patent No.: US 9,675,152 B2
(45) Date of Patent: Jun. 13, 2017

(54) ELECTRONIC SECURITY BAG CONTROLLED BY MOBILE PHONE

(71) Applicants: TAEBAEK SECURITY CONSULTING INC, Gyeryong-si, Chungcheongnam-do (KR); Kang Su Lim, Gyeryong-si (KR)

(72) Inventors: Kang Su Lim, Gyeryong-si (KR); Won Sik Oh, Seongnam-si (KR); Young Bae Kwon, Yongin-si (KR); Eal Young Ryu, Daejeon (KR); Jun Hui Cho, Seoul (KR); Ho Jin Lim, Sejong (KR)

(73) Assignees: TAEBAEK SECURITY CONSULTING INC., Gyeryong-si, Chungcheongnam-Do (KR); Kang Su Lim, Gyeryong-si, Chungcheongnam-Do (KR)

( * ) Notice: Subject to any disclaimer, the term of this patent is extended or adjusted under 35 U.S.C. 154(b) by 0 days.

(21) Appl. No.: 14/906,237

(22) PCT Filed: Jul. 21, 2014

(86) PCT No.: PCT/KR2014/006581
§ 371 (c)(1),
(2) Date: Jan. 19, 2016

(87) PCT Pub. No.: WO2015/009120
PCT Pub. Date: Jan. 22, 2015

(65) Prior Publication Data

US 2016/0143407 A1 May 26, 2016

(30) Foreign Application Priority Data

Jul. 19, 2013 (KR) ..... 10-2013-0085536

(51) Int. Cl.
*G08B 13/14* (2006.01)
*A45C 13/18* (2006.01)
(Continued)

(52) U.S. Cl.
CPC ..... *A45C 13/18* (2013.01); *A45C 13/24* (2013.01); *G07C 9/00309* (2013.01); *G07C 2009/00769* (2013.01)

(58) Field of Classification Search
CPC ..... G06Q 30/0255; G06Q 30/0273; G06Q 30/0246; G06Q 30/02; G06Q 30/0277;
(Continued)

(56) References Cited

U.S. PATENT DOCUMENTS

2006/0145847 A1* 7/2006 Simpson ..... G08B 5/00 340/568.1

FOREIGN PATENT DOCUMENTS

KR 20-1989-0005406 Y1 8/1989
KR 10-2003-0028539 A 4/2003
(Continued)

*Primary Examiner* — Dhaval Patel
(74) *Attorney, Agent, or Firm* — John K. Park; Park Law Firm

(57) ABSTRACT

The invention relates to an electronic security bag controlled by a mobile phone, whereby the bag performs Bluetooth communication with the mobile phone of a person who carries the bag, sounds an alarm when the Bluetooth communication is disconnected (when not in a paring mode), and gives an electric shock to an authorized person who touches the bag by allowing high-voltage current applied from power supply of the security bag to flow entirely in the bag. The bag providing a control method through paring with the mobile phone can safely manage important information assets by remotely controlling the alarm of the bag and locking/unlocking thereof. Further, when separated a predetermined distance from a manager, the security bag transmits
(Continued)

a warning signal to the mobile phone, sounds the alarm of the bag, and generates high-voltage current on the bag when forcibly opened, thereby preventing security documents from being stolen.

7 Claims, 3 Drawing Sheets

(51) Int. Cl.
*A45C 13/24* (2006.01)
*G07C 9/00* (2006.01)

(58) Field of Classification Search
CPC ..... G06Q 30/0269; G06Q 30/0249; G06Q 30/0241; G06Q 30/0247; G06Q 30/0242; H04L 67/22; H04L 67/306
USPC ..... 340/568.7, 539.13, 539.1, 568.6, 10.1, 340/572.1, 572.4; 713/165, 168; 726/19, 726/35
See application file for complete search history.

(56) References Cited

FOREIGN PATENT DOCUMENTS

KR 10-2005-0089287 A 9/2005
KR 10-2009-0027961 A 3/2009

* cited by examiner

ELECTRONIC SECURITY BAG CONTROLLED BY MOBILE PHONE

TECHNICAL FIELD

The present invention generally relates to an electronic security bag controlled by a mobile phone. More particularly, the present invention relates to an electronic security bag controlled by a mobile phone, whereby the bag performs Bluetooth communication with the mobile phone of a person who carries the bag, sounds an alarm when the Bluetooth communication is disconnected (when not in a paring mode), and gives an electric shock to an authorized person who touches the bag by allowing a high-voltage current applied from a power supply of the security bag to flow entirely in the bag.

BACKGROUND ART

A conventional security bag is configured in such a manner that after keeping important documents in an inner space of the bag, the security bag is locked by entering a password of a locking device.

Later, when reaching a desired destination, the important documents are available by entering the password of the locking device.

However, since security of the above-mentioned method is vulnerable, it is possible that an unauthorized person obtains the documents stored in the security bag when he or she acquires the password, or when the unauthorized person breaks the security bag without knowing the password.

Accordingly, it is required to provide a technology that can improve security of a security bag and can allow a user of the security bag to immediately respond when the user loses the security bag, or the security bag is stolen.

Meanwhile, Bluetooth is a technology for exchanging voices and data over short distances by wirelessly connecting mobile devices such as a portable PC and a mobile phone at low cost.

For example, when the Bluetooth technology is realized in a mobile phone and a laptop computer, it is unnecessary to use cables currently used for connecting the mobile phone and the laptop computer, and thus the mobile devices are free from the cables, and further the Bluetooth technology serves to build interfaces between an existing data network and peripheral devices, and to build specific groups between devices located away from a fixed network infrastructure.

In addition, since the Bluetooth is designed to operate in a radio frequency atmosphere having much noise, the Bluetooth using fast recognition and a radio hopping system avoids interference from other signals, and allows data to be stably transmitted and received using fast and short packets when compared to other systems operating in the same frequency band.

Removing problems of the above-mentioned conventional technology, an electronic security bag using Bluetooth technology according to the present invention enables a user of the security bag to control the security bag anytime and anywhere.

DISCLOSURE

Technical Problem

Accordingly, the present invention has been made keeping in mind the above problems occurring in the related art, and the present invention is intended to propose an electronic security bag controlled by a mobile phone, whereby the mobile phone can remotely control sounding an alarm of the security bag and can lock/unlock the security bag via pairing with the mobile phone.

The present invention is also intended to propose an electronic security bag controlled by a mobile phone, that when separated a predetermined distance from a manager, transmits a warning signal to the mobile phone, sounds an alarm in the bag, and generates a high-voltage current on the bag when forcibly opened, thereby preventing security documents from being stolen.

The present invention is still intended to propose an electronic security bag controlled by a mobile phone, whereby the security bag can quickly respond by automatically transmitting information about its disappearance, time when it disappeared, and its location to preset management numbers when the bag is lost or stolen.

The present invention is still intended to propose an electronic security bag controlled by a mobile phone, the bag only permitting opening of itself by a signal transmitted from the mobile phone, thereby making it difficult for the security bag to be opened by unauthorized persons.

Technical Solution

In order to achieve the above object, according to one aspect of the present invention, there is provided an electronic security bag controlled by a mobile phone, the electronic security bag including: a bag 100 including: an electronic locking/unlocking unit 120 that locks the bag when receiving a locking signal transmitted from a mobile phone, and that unlocks the bag when receiving an unlocking signal transmitted from the mobile phone; a Bluetooth communication unit 130 that transmits and receives data via Bluetooth communication with the mobile phone; a power supply unit 140 supplying power to the bag; a memory unit 150 stored with an identification code of the bag; a password identification unit 160 for identifying a password transmitted from the mobile phone; an alarm unit 170 sounding an alarm when the bag is separated from the mobile phone; a charged state identification unit 180 for identifying a charged state of the power supply unit; an identification code extraction unit 190 extracting the identification code of the bag from the memory unit when the mobile phone asks the identification code of the bag; and a central control unit 197 that controls flow of signals between the respective units, and a mobile phone 200 for controlling locking/unlocking of the bag.

In addition, the bag 100 may further include: a high-voltage current generation unit 110 for generating a high-voltage current on a surface of the bag and on a handle of the bag when pairing via the Bluetooth communication is disconnected due to separation of the bag from the predetermined mobile phone.

Advantageous Effects

According to the present invention having the above-described characteristics, it is possible to propose an electronic security bag controlled by a mobile phone, whereby the mobile phone can remotely control sounding an alarm of the security bag, and can lock/unlock of the security bag via pairing therewith, thereby stably managing important information assets.

In addition, when separated a predetermined distance from a manager, the security bag transmits a warning signal to the mobile phone, sounds an alarm in the bag, and generates high-voltage current on the bag when forcibly opened, thereby preventing security documents from being stolen.

Furthermore, when the security bag is lost or stolen, the electronic security bag controlled by the mobile phone can quickly respond by automatically transmitting information about its disappearance, time when it disappeared, and its location to preset management numbers.

Additionally, the electronic security bag controlled by the mobile phone allows the security bag to only be opened by a signal transmitted from the mobile phone, thereby making it difficult for the security bag to be damaged or forcibly opened.

MODE FOR INVENTION

Figure 1:
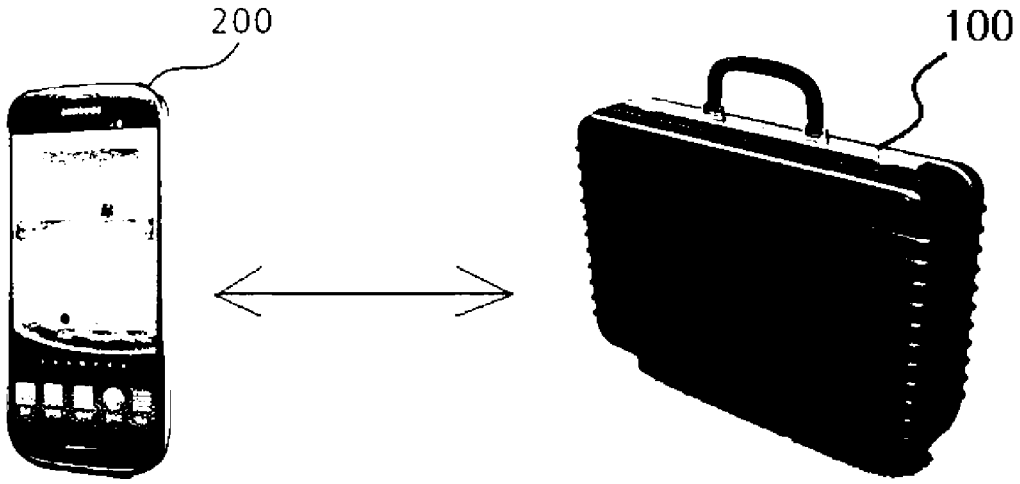
FIG. 1 is a diagram showing an entire configuration of an electronic security bag controlled by a mobile phone according to an embodiment of the present invention.

To achieve the above-mentioned objects, an electronic security bag controlled by a mobile phone according to an embodiment of the present invention includes: a bag 100 including: an electronic locking/unlocking unit 120 that locks the bag when receiving a locking signal transmitted from the mobile phone 200, and that unlocks the bag when receiving an unlocking signal transmitted from the mobile phone 200; a Bluetooth communication unit 130 that transmits and receives data via Bluetooth communication with the mobile phone; a power supply unit 140 supplying power to the bag; a memory unit 150 storing an identification code of the bag; a password identification unit 160 for identifying a password transmitted from the mobile phone 200; an alarm unit 170 sounding an alarm when the bag is separated from the mobile phone; a charged state identification unit 180 for identifying a charged state of the power supply unit; an identification code extraction unit 190 extracting the identification code of the bag from the memory unit 150 when the mobile phone 200 asks the identification code of the bag; and a central control unit 197 that controls flow of signals between the respective units, and the mobile phone 200 for controlling locking/unlocking of the electronic security bag.

In this case, the electronic-security-bag 100 further includes: a high-voltage current generation unit 110 for generating high-voltage current on the bag and on a handle thereof when pairing via the Bluetooth communication is disconnected due to separation of the bag from the predetermined mobile phone; a tag information reading unit 191 for reading tag information of a document kept in the bag; and a tag information processing unit 192 storing the read tag information of the document in the memory unit 150, wherein the memory unit is further stored with information about a list of the document kept in the bag.

In this case, the mobile phone 200 transmits the identification code of the bag, location information of the bag, and time information of the bag to a stored management number when the Bluetooth communication is disconnected.

In this case, the mobile phone 200 includes: a locking/unlocking signal supply unit 210 for supplying the locking or unlocking signal to the electronic security bag; a security mode convert unit 220 sounding an alarm by converting a mode of the bag into a security mode when the Bluetooth communication is disconnected; and a high-voltage current generation signal supply unit 230 for supplying a high-voltage current generation signal to the electronic security bag.

In this case, the mobile phone 200 further includes: a communication distance setting unit 240 for setting a communication distance; and a maximum distance change unit 250 for automatically changing the communication distance into a maximum distance and transmitting a signal to the electronic security bag when a command to give electric shock is given.

In this case, the electronic-security-bag 100 is locked or unlocked only by the locking or unlocking signal of the mobile phone 200.

In this case, the high-voltage current generation unit 110 is provided in the bag, the high-voltage current generation unit generating the high-voltage current when the bag is abnormally opened except when the unlocking signal is transmitted from the mobile phone 200.

In this case, the power supply unit 140 includes: a first power supply unit 141 for supplying power to the Bluetooth communication unit; and a second power supply unit 142 for supplying power to the electronic locking/unlocking unit 120.

In this case, the electronic-security-bag 100 further includes a power supply warning signal generation unit 195 for transmitting a warning signal to the mobile phone 200 when charge of the power supply unit 140 is identified to be insufficient.

Hereinafter, the electronic security bag controlled by the mobile phone will be described in detail according to the embodiment of the present invention.

That is, the present invention relates to the electronic security bag controlled by the mobile phone, whereby the security bag performs the Bluetooth communication with the mobile phone of a person who owns the bag, sounds the alarm when the Bluetooth communication is disconnected (when not in a paring mode), and gives an electric shock to an authorized person who touches the bag by allowing high-voltage current applied from a power supply of the security bag to flow on an entirety of or a portion of the security bag.

FIG. 1 is a diagram showing an entire configuration of the electronic security bag controlled by the mobile phone according to the embodiment of the present invention.

As shown in FIG. 1, the electronic security bag of the present invention generates high-voltage current, and includes the electronic-security-bag and the mobile phone, wherein the electronic-security-bag performs the Bluetooth communication with the mobile phone, and the mobile phone controls the electronic security bag.

It is characteristic that since a password is preset, the password is entered, and then the security bag is locked, it is impossible to unlock the security bag unless the predetermined mobile phone clears the password.

The above-mentioned method is a safe security means, and it is impossible for anyone to unlock the security bag except for a manager who has the password.

In addition, the security bag remotely controls functions such as sounding the alarm of the bag and locking/unlocking thereof via paring with the mobile phone 200, thereby safely managing important information assets. For example, when the bag is separated at least a predetermined distance, 3 m~5 m from the manager, the security bag transmits a warning signal to the mobile phone, sounds the alarm in the bag, and generates high-voltage current on the bag when forcibly opened.

Furthermore, when the security bag is lost or stolen, the electronic security bag controlled by the mobile phone can quickly respond by automatically transmitting information about its disappearance, the time information thereof, and the location information thereof to preset management numbers.

Figure 2:
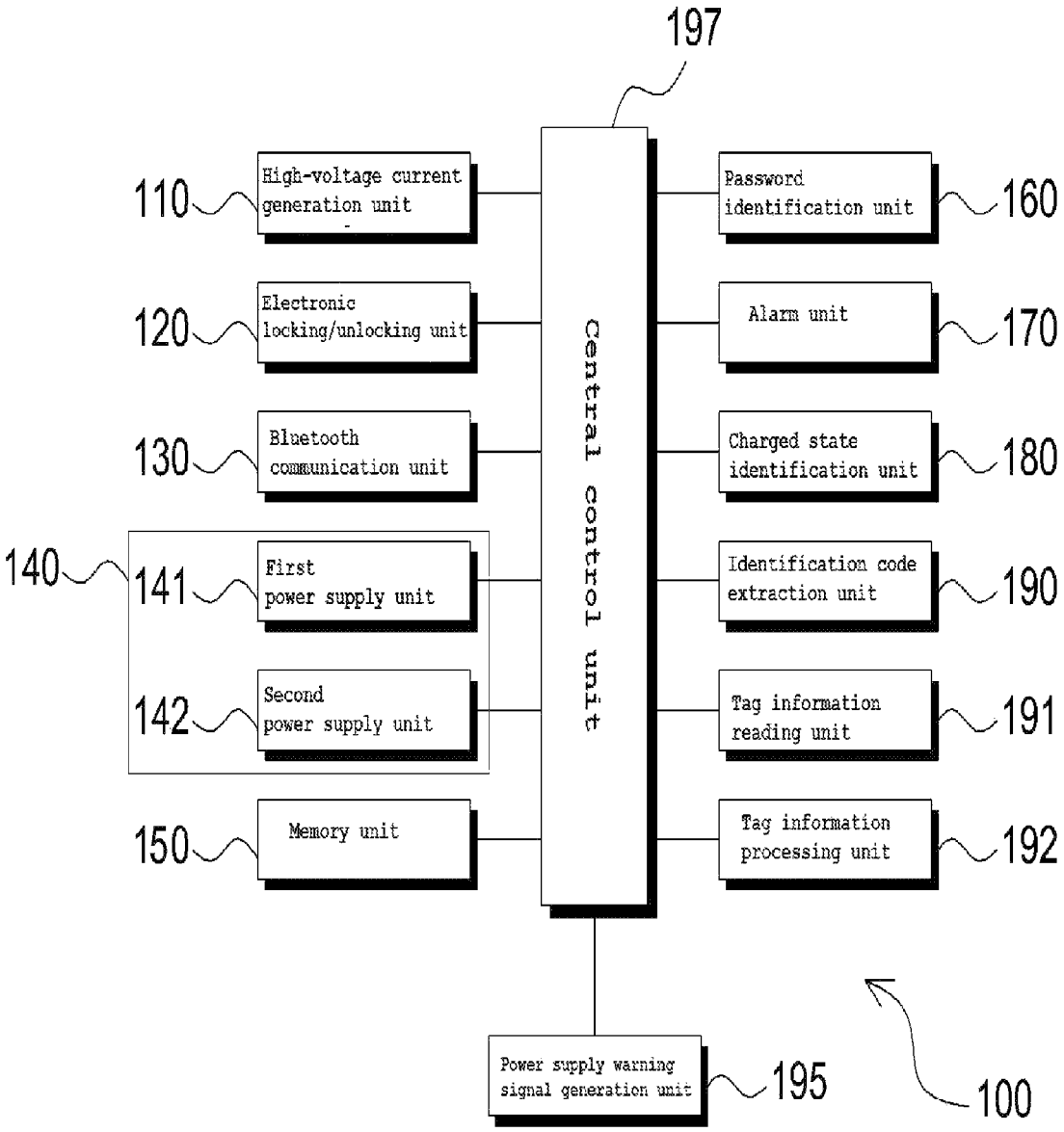
FIG. 2 is a block diagram of an electronic control part of a bag of the electronic security bag controlled by the mobile phone according to the embodiment of the present invention.

FIG. 2 is a block diagram of an electronic control part of the bag of the electronic security bag controlled by the mobile phone according to the embodiment of the present invention As shown in FIG. 2, the electronic-security-bag 100 includes: the high-voltage current generation unit 110 for generating high-voltage current on the surface of the bag and on the handle thereof when pairing via the Bluetooth communication is disconnected due to separation of the bag from the predetermined mobile phone; the electronic locking/unlocking unit 120 that locks the bag when receiving the locking signal transmitted from the mobile phone 200, and that unlocks the bag when receiving the unlocking signal transmitted from the mobile phone 200; the Bluetooth communication unit 130 that transmits and receives data via Bluetooth communication with the mobile phone 200; the power supply unit 140 supplying power to the bag; the memory unit 150 stored with the identification code of the bag; the password identification unit 160 for identifying the password transmitted from the mobile phone 200; the alarm unit 170 sounding the alarm when the bag is separated from the mobile phone; the charged state identification unit 180 for identifying the charged state of the power supply unit 140; the identification code extraction unit 190 extracting the identification code of the bag from the memory unit 150 when the mobile phone 200 asks the identification code of the bag; and the central control unit 197 that controls flow of signals between the respective units.

The high-voltage current generation unit 110 generates high-voltage current on the bag and on the handle thereof when pairing via the Bluetooth communication is disconnected due to separation of the bag from the predetermined mobile phone.

For example, the high-voltage current generation unit 110 gives an electric shock to an authorized person who touches the bag by allowing 76,000V to flow on the bag.

The electronic locking/unlocking unit 120 locks the bag when receiving the locking signal transmitted from the mobile phone 200, and unlocks the bag when receiving the unlocking signal transmitted from the mobile phone 200.

For example, the electronic security bag is electronically locked or unlocked by including a solenoid valve.

In addition, the Bluetooth communication unit 130 transmits and receives data via Bluetooth communication with the mobile phone 200.

Since the memory unit 150 is stored with the identification code of the bag, the mobile phone 200 can identify the identification code of the bag when the mobile phone performs communication with the memory unit 150.

The password identification unit 160 identifies the password transmitted from the mobile phone 200.

That is, when the password is preset in the mobile phone 200, the central control unit 197 receives the password, and stores the password in the memory unit 150.

Later, when the password identification unit 160 receives the password transmitted from the mobile phone 200, the password identification unit determines whether the password corresponds to the password stored in the memory unit 150, and if the two passwords correspond to each other, the bag is unlocked.

The alarm unit 170 sounds the alarm when the bag is separated from the mobile phone 200.

That is, when the Bluetooth communication is disconnected, the central control unit 197 detects the fact that the Bluetooth communication is disconnected, and transmits an operation signal to the alarm unit 170, and when the alarm unit 170 receives the operation signal, the alarm unit sounds the alarm.

Furthermore, the charged state identification unit 180 identifies the charged state of the power supply unit 140.

When the power supply unit 140 is not charged, the electronic security bag cannot properly perform the function thereof. Accordingly, the power supply unit 140 requires identifying the state of charge thereof, and the state of charge thereof should be transmitted to the mobile phone 200.

In addition, the identification code extraction unit 190 extracts the identification code of the bag from the memory unit 150 when the mobile phone asks the identification code of the bag.

Meanwhile, the electronic-security-bag 100 includes: the tag information reading unit 191 for reading tag information of a document kept in the bag; and the tag information processing unit 192 storing the read tag information of the document in the memory unit 150, wherein the memory unit is further stored with information about a list of the documents kept in the bag.

That is, security documents are stored in the bag, and RFID tags are attached to the security documents, thereby preventing the security documents from being copied.

In this case, the electronic security bag including the tag information processing unit 192 stores tag information in the memory unit 150.

The tag information stored in the memory unit 150 is transmitted to the mobile phone 200, and the mobile phone can identify the information of the tags anytime.

Accordingly, since the carrier of the bag can know whether the security documents are in the bag without opening the bag, the carrier does not need to open the bag so as to see whether the security documents are in the bag.

Advantages of the above-mentioned configuration are that the security bag enables the carrier to know whether contents are properly kept in the bag, to identify a list of the contents of the bag, and to transmit the list to a receiver who wants the list since the list of the contents of the bag is stored in the memory unit 150.

Meanwhile, the high-voltage current generation unit 110 is provided in the bag, and generates the high-voltage current when the bag is abnormally opened except when the unlocking signal is transmitted from the mobile phone 200.

That is, the high-voltage current generation unit 110 is provided on the surface of the bag and in the bag.

When the bag is stolen, the high-voltage current generation unit 110 automatically generates the high-voltage current one time on the surface of the bag, and the carrier of the mobile phone can also manually operate the high-voltage current generation unit 110 using the mobile phone.

The high-voltage current generation unit 110 gives electric shock to the unauthorized person who abnormally opens the bag to steal the documents kept in the bag.

Meanwhile, the power supply unit 140 includes: the first power supply unit 141 for supplying power to the Bluetooth communication unit; and the second power supply unit 142 for supplying power to the electronic locking/unlocking unit 120.

That is, when a battery of the power supply is discharged, the power supply unit 140 prevents the bag from being locked, and the power supply unit prevents the Bluetooth communication unit 130 from being forcibly disconnected when the bag is lost or stolen.

In addition, power supply of the Bluetooth communication unit 130 is replaced only in the bag, and a battery of the electronic locking/unlocking unit 120 can be replaced on the surface of the bag.

Meanwhile, the alarm of the security bag of the present invention is automatically activated when the security bag is not in a pairing mode with the mobile phone, but the security bag can also be configured to sound the alarm while the bag owner performs a FIND ME function when the owner wants.

Meanwhile, according to another aspect of the present invention, the electronic-security-bag 100 may further include the power supply warning signal generation unit 195 for transmitting a warning signal to the mobile phone when charge of the power supply unit 140 is identified to be insufficient.

That is, since the electronic security bag cannot perform the function thereof when the charge of the power supply unit 140 is insufficient, it is required that the insufficient state of charge of the power supply unit be transmitted to the mobile phone 200.

Figure 3:
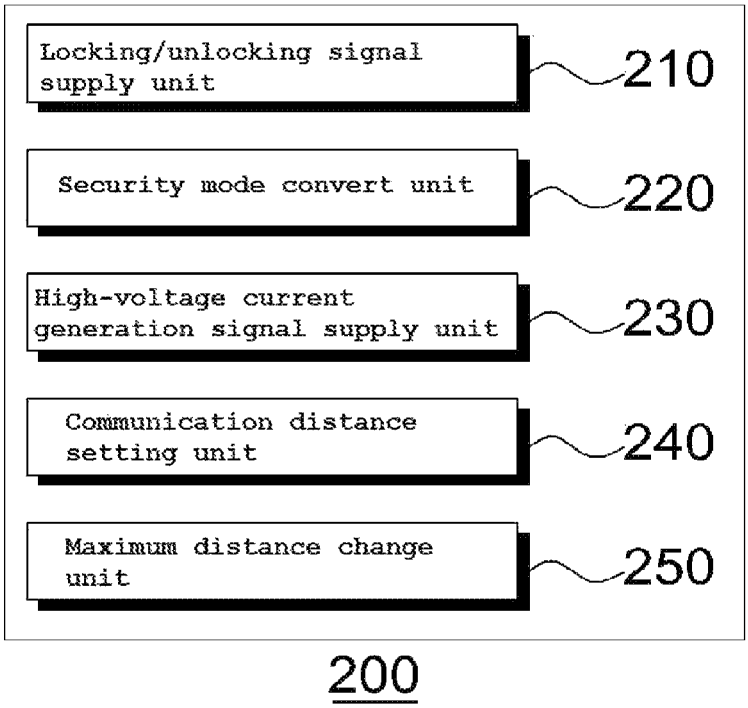
FIG. 3 is a block diagram of an electronic control part of a mobile phone of the electronic security bag controlled by the mobile phone according to the embodiment of the present invention.

FIG. 3 is a block diagram of an electronic control part of the mobile phone of the electronic security bag controlled by the mobile phone according to the embodiment of the present invention.

As shown in FIG. 3, the mobile phone 200 includes the locking/unlocking signal supply unit 210 for supplying the locking or unlocking signal to the electronic security bag; the security mode convert unit 220 sounding the alarm by converting the mode of the bag into a security mode when the Bluetooth communication is disconnected; and the high-voltage current generation signal supply unit 230 for supplying a high-voltage current generation signal to the electronic security bag.

That is, the locking/unlocking signal supply unit 210 supplies the locking or unlocking signal to the electronic security bag.

When supplied with the locking signal, the bag is locked, and when supplied with the unlocking signal, the bag is unlocked.

An application for controlling the electronic security bag is loaded in the mobile phone 200, and the application includes icons that a user of the mobile phone 200 can use.

When the Bluetooth communication is disconnected, the security mode convert unit 220 converts the bag into the security mode, and sounds the alarm of the bag.

Then, the user can know that the bag is beyond a distance he or she set in advance.

The high-voltage current generation signal supply unit 230 supplies the high-voltage current generation signal to the electronic-security-bag.

That is, the security bag can automatically and manually generate the high-voltage current.

Meanwhile, according to still another aspect of the present invention, the mobile phone 200 may further include: the communication distance setting unit 240 for setting the communication distance; and the maximum distance change unit 250 for automatically changing the communication distance into the maximum distance and transmitting a signal to the bag when the command to give electric shock is given.

That is, the user of the mobile phone 200 sets the communication distance using the communication distance setting unit 240.

For example, when the user of the mobile phone sets a communication distance of 5 m, the communication distance becomes 5 m.

When the command to give electric shock is given, the maximum distance change unit 250 automatically changes the communication distance into the maximum distance and transmits a signal to the bag.

According to the present invention having the above-described characteristics, the electronic security bag controlled by the mobile phone can remotely control sounding the alarm of the security bag and locking/unlocking of the security bag via pairing with the mobile phone, thereby stably managing important information assets.

In addition, when the bag is separated the predetermined distance from the manager, the security bag transmits a warning signal to the mobile phone, sounds the alarm of the bag, and generates high-voltage current on the bag when forcibly opened, thereby preventing security documents from being stolen.

Furthermore, when the bag is lost, information that the bag is lost is automatically transmitted to predetermined contact numbers of the mobile phone owner, acquaintances, and a police station stored in the application of the mobile phone. In this case, when the Bluetooth communication is disconnected, it is possible to transmit the identification code of the missing bag, the location information thereof and the time information thereof to stored management numbers by using positioning function of the mobile phone. Additionally, since the bag further includes a GPS unit (not shown) positioning the bag, and a communication unit (not shown) where mobile communication or wireless communication including a radio frequency can be performed, it is possible to constantly transmit the identification code of the missing bag, the location information thereof, and the time information thereof to preset management numbers though the bag cannot be paired with the mobile phone via the Bluetooth communication since the bag is away from the mobile phone. Though it is possible to transmit the above-mentioned information using a conventional positioning system, it is preferred that long-range communication or mobile communication is used since wireless communication of the conventional positioning system has limitation of distance in transmitting.

Although the embodiment of the present invention have been disclosed for illustrative purposes, those skilled in the art will appreciate that various modifications, additions and substitutions are possible, without departing from the scope and spirit of the invention as disclosed in the accompanying claims.

The scope of the present invention is represented by the claims mentioned below rather than above-mentioned detailed description, and the meaning and the scope of the claims, and all such modifications that would be derived from the equivalent concepts should be interpreted to be included in the scope of the present invention.

INDUSTRIAL APPLICABILITY

An electronic security bag controlled by a mobile phone according to the present invention can be used in a normal portable bag and in various carriers that requires security.

The invention claimed is:

1. An electronic security bag controlled by a mobile phone, the electronic security bag comprising:

a bag (100) including:

a high-voltage current generation unit (110) configured for generating a high-voltage current on a surface of the bag and on a handle of the bag when pairing via the Bluetooth communication is disconnected due to separation of the bag from a predetermined mobile phone;

an electronic locking/unlocking unit (120) configured for locking the bag when receiving a locking signal transmitted from a mobile phone, and unlocking the bag when receiving an unlocking signal transmitted from the mobile phone;

a Bluetooth communication unit (130) configured for transmitting and receives data via Bluetooth communication with the mobile phone;

a power supply unit (140) configured for supplying power to the bag;

a memory unit (150) configured for storing an identification code of the bag;

a password identification unit (160) configured for identifying a password transmitted from the mobile phone;

an alarm unit (170) configured for sounding an alarm when the bag is separated from the mobile phone;

a charged state identification unit (180) configured for identifying a charged state of the power supply unit;

an identification code extraction unit (190) configured for extracting the identification code of the bag from the memory unit when the mobile phone asks the identification code of the bag; and a central control unit (197) configured for controlling flow of signals between the respective units, and a mobile phone (200) configured for controlling locking/unlocking of the bag;

wherein the mobile phone (200) includes:

a locking/unlocking signal supply unit (210) configured for supplying the locking or unlocking signal to the bag;

a security mode convert unit (220) configured for sounding the alarm by converting a mode of the bag into a security mode when the Bluetooth communication is disconnected; and a high-voltage current generation signal supply unit (230) configured for supplying a high-voltage current generation signal to the bag, wherein the mobile phone (200) further includes:

a communication distance setting unit (240) configured for setting a communication distance; and a maximum distance change unit (250) configured for automatically changing the communication distance into a maximum distance and transmitting a signal to the bag when a command to apply electric shock is given.

2. An electronic security bag controlled by a mobile phone, the electronic security bag comprising:

a bag (100) including:

a high-voltage current generation unit (110) configured for generating a high-voltage current on a surface of the bag and on a handle of the bag when pairing via the Bluetooth communication is disconnected due to separation of the bag from a predetermined mobile phone;

an electronic locking/unlocking unit (120) configured for locking the bag when receiving a locking signal transmitted from a mobile phone, and unlocking the bag when receiving an unlocking signal transmitted from the mobile phone;

a Bluetooth communication unit (130) configured for transmitting and receives data via Bluetooth communication with the mobile phone;

a power supply unit (140) configured for supplying power to the bag;

a memory unit (150) configured for storing an identification code of the bag;

a password identification unit (160) configured for identifying a password transmitted from the mobile phone;

an alarm unit (170) configured for sounding an alarm when the bag is separated from the mobile phone;

a charged state identification unit (180) configured for identifying a charged state of the power supply unit;

an identification code extraction unit (190) configured for extracting the identification code of the bag from the memory unit when the mobile phone asks the identification code of the bag; and a central control unit (197) configured for controlling flow of signals between the respective units, and a mobile phone (200) configured for controlling locking/unlocking of the bag;

wherein the mobile phone (200) includes:

a locking/unlocking signal supply unit (210) configured for supplying the locking or unlocking signal to the bag;

a security mode convert unit (220) configured for sounding the alarm by converting a mode of the bag into a security mode when the Bluetooth communication is disconnected; and a high-voltage current generation signal supply unit (230) configured for supplying a high-voltage current generation signal to the bag, wherein the bag (100) further includes:

a tag information reading unit (191) for reading tag information of a document kept in the bag; and a tag information processing unit (192) storing the read tag information of the document in the memory unit, wherein the memory unit is further stored with information about a list of the document kept in the bag, wherein the mobile phone (200) further includes:

a communication distance setting unit (240) for setting a communication distance; and a maximum distance change unit (250) for automatically changing the communication distance into a maximum distance and transmitting a signal to the bag when a command to apply electric shock is given.

3. An electronic security bag controlled by a mobile phone, the electronic security bag comprising:

a bag (100) including:

a high-voltage current generation unit (110) configured for generating a high-voltage current on a surface of the bag and on a handle of the bag when pairing via the Bluetooth communication is disconnected due to separation of the bag from a predetermined mobile phone;

an electronic locking/unlocking unit (120) configured for locking the bag when receiving a locking signal transmitted from a mobile phone, and unlocking the bag when receiving an unlocking signal transmitted from the mobile phone;

a Bluetooth communication unit (130) configured for transmitting and receives data via Bluetooth communication with the mobile phone;

a power supply unit (140) configured for supplying power to the bag;

a memory unit (150) configured for storing an identification code of the bag;

a password identification unit (160) configured for identifying a password transmitted from the mobile phone;

an alarm unit (170) configured for sounding an alarm when the bag is separated from the mobile phone;

a charged state identification unit (180) configured for identifying a charged state of the power supply unit;

an identification code extraction unit (190) configured for extracting the identification code of the bag from the memory unit when the mobile phone asks the identification code of the bag; and a central control unit (197) configured for controlling flow of signals between the respective units, and a mobile phone (200) configured for controlling locking/unlocking of the bag;

wherein the mobile phone (200) includes:

a locking/unlocking signal supply unit (210) configured for supplying the locking or unlocking signal to the bag;

a security mode convert unit (220) configured for sounding the alarm by converting a mode of the bag into a security mode when the Bluetooth communication is disconnected; and a high-voltage current generation signal supply unit (230) configured for supplying a high-voltage current generation signal to the bag, wherein at least one of the mobile phone (200) and the bag (100) transmits the identification code of the bag, location information of the bag, and time information to a stored management number when the Bluetooth communication is disconnected, wherein the mobile phone (200) further includes:

a communication distance setting unit (240) for setting a communication distance; and a maximum distance change unit (250) for automatically changing the communication distance into a maximum distance and transmitting a signal to the bag when a command to apply electric shock is given.

4. An electronic security bag controlled by a mobile phone, the electronic security bag comprising:

a bag (100) including:

a high-voltage current generation unit (110) configured for generating a high-voltage current on a surface of the bag and on a handle of the baa when pairing via the Bluetooth communication is disconnected due to separation of the bag from a predetermined mobile phone;

an electronic locking/unlocking unit (120) configured for locking the baa when receiving a locking signal transmitted from a mobile phone, and unlocking the baa when receiving an unlocking signal transmitted from the mobile phone;

a Bluetooth communication unit (130) configured for transmitting and receives data via Bluetooth communication with the mobile phone;

a power supply unit (140) configured for supplying power to the bag;

a memory unit (150) configured for storing an identification code of the bag;

a password identification unit (160) configured for identifying a password transmitted from the mobile phone;

an alarm unit (170) configured for sounding an alarm when the bag is separated from the mobile phone;

a charged state identification unit (180) configured for identifying a charged state of the power supply unit;

an identification code extraction unit (190) configured for extracting the identification code of the bag from the memory unit when the mobile phone asks the identification code of the bag; and a central control unit (197) configured for controlling flow of signals between the respective units, and a mobile phone (200) configured for controlling locking/unlocking of the bag;

wherein the mobile phone (200) includes:

a locking/unlocking signal supply unit (210) configured for supplying the locking or unlocking signal to the bag;

a security mode convert unit (220) configured for sounding the alarm by converting a mode of the bag into a security mode when the Bluetooth communication is disconnected; and a high-voltage current generation signal supply unit (230) configured for supplying a high-voltage current generation signal to the bag, wherein the bag (100) further includes:

a tag information reading unit (191) for reading tag information of a document kept in the bag; and a tag information processing unit (192) storing the read tag information of the document in the memory unit, wherein the memory unit is further stored with information about a list of the document kept in the bag, wherein at least one of the mobile phone (200) and the bag (100) transmits the identification code of the bag, location information of the bag, and time information to a stored management number when the Bluetooth communication is disconnected, wherein the mobile phone (200) further includes:

a communication distance setting unit (240) for setting a communication distance; and a maximum distance change unit (250) for automatically changing the communication distance into a maximum distance and transmitting a signal to the bag when a command to apply electric shock is given.

5. The electronic security bag of claim 1, wherein the high-voltage current generation unit (110) is provided in the bag, the high-voltage current generation unit generating the high-voltage current when the bag is abnormally opened except when the unlocking signal is transmitted from the mobile phone.

6. The electronic security bag of claim 1, wherein the power supply unit (140) includes:

a first power supply unit (141) for supplying power to the Bluetooth communication unit; and a second power supply unit (142) for supplying power to the electronic locking/unlocking unit.

7. The electronic security bag of claim 2, wherein the power supply unit (140) includes:

a first power supply unit (141) for supplying power to the Bluetooth communication unit; and a second power supply unit (142) for supplying power to the electronic locking/unlocking unit.

* * * * *